US008087540B2

(12) United States Patent
Bailey et al.

(10) Patent No.: US 8,087,540 B2
(45) Date of Patent: Jan. 3, 2012

(54) DISPENSING CONTAINER FOR METERED DISPENSING OF PRODUCT

(75) Inventors: Ryan A. Bailey, Raleigh, NC (US); John A. Gelardi, Wake Forest, NC (US)

(73) Assignee: R.J. Reynolds Tabacco Company, Winston-Salem, NC (US)

( * ) Notice: Subject to any disclaimer, the term of this patent is extended or adjusted under 35 U.S.C. 154(b) by 369 days.

(21) Appl. No.: 12/425,180

(22) Filed: Apr. 16, 2009

(65) Prior Publication Data

US 2010/0264157 A1 Oct. 21, 2010

(51) Int. Cl.
*G07F 11/00* (2006.01)

(52) U.S. Cl. ..... 221/246; 221/104; 221/186; 221/267; 221/268

(58) Field of Classification Search ..... 221/246, 221/186, 267, 268, 104, 232, 247, 264, 88, 221/198
See application file for complete search history.

(56) References Cited

U.S. PATENT DOCUMENTS

| | | | | |
|---|---|---|---|---|
| 194,197 | A | 8/1877 | Villaret | |
| 533,044 | A | 1/1895 | Bingham | |
| 889,568 | A | 6/1908 | Albrecht | |
| 1,701,565 | A | 2/1929 | Hammett | |
| 1,837,722 | A | 12/1931 | McAtree | |
| 1,963,025 | A * | 6/1934 | Mackie | 221/249 |
| 2,090,530 | A | 8/1937 | Guffey et al. | |
| 2,645,336 | A * | 7/1953 | Waber et al. | 221/246 |
| 2,769,565 | A | 11/1956 | Sottile | |
| 3,563,412 | A | 2/1971 | James | |
| 3,696,917 | A | 10/1972 | Levi | |
| 3,761,009 | A | 9/1973 | Resenberg | |
| 3,782,584 | A | 1/1974 | Swenson et al. | |
| 3,895,737 | A | 7/1975 | Phillips | |
| 4,007,828 | A | 2/1977 | Mayled | |
| 4,057,145 | A | 11/1977 | Wray et al. | |
| 4,076,117 | A | 2/1978 | Wisdom et al. | |
| 4,113,098 | A | 9/1978 | Howard | |
| 4,154,365 | A | 5/1979 | Lorca | |
| 4,275,819 | A | 6/1981 | Perez | |
| 4,278,185 | A * | 7/1981 | Perez | 221/104 |
| 4,284,204 | A | 8/1981 | Carey, Jr. | |
| 4,364,488 | A | 12/1982 | Anjou | |
| 4,437,579 | A | 3/1984 | Obland | |

(Continued)

FOREIGN PATENT DOCUMENTS

CH 180 218 A 10/1935

(Continued)

*Primary Examiner* — Mark A Deuble
(74) *Attorney, Agent, or Firm* — Womble Carlyle Sandridge & Rice, LLP

(57) ABSTRACT

A dispensing container is provided, including an outer casing having an open end, a top, a bottom, sidewalls extending between the top and bottom, and an interior compartment; an inner tray slidably received within the interior compartment of the outer casing and including a storage compartment configured to store a plurality of units of product to be dispensed, and a dispensing trough in communication with the storage compartment, the inner tray extending outwardly from the open end of the outer casing and configured for sliding movement between a closed and locked position and a dispensing position, wherein the dispensing trough includes an aperture sized to allow a single unit of product exit the dispensing trough at one end thereof and a slot at the opposing end thereof, and the outer casing further includes a rib extending into the interior compartment and positioned to enter the slot of the dispensing trough.

29 Claims, 17 Drawing Sheets

U.S. PATENT DOCUMENTS

| | | | | |
|---|---|---|---|---|
| 4,561,544 | A * | 12/1985 | Reeve | 206/540 |
| 4,572,376 | A | 2/1986 | Wrennall | |
| 4,611,727 | A | 9/1986 | Graff | |
| 4,705,165 | A | 11/1987 | Thieke | |
| 4,741,435 | A | 5/1988 | Clarke | |
| 4,939,860 | A | 7/1990 | Ackeret | |
| 4,967,909 | A | 11/1990 | McKibben | |
| 5,080,222 | A | 1/1992 | McNary | |
| 5,082,137 | A | 1/1992 | Weinstein | |
| 5,108,006 | A | 4/1992 | Tieke et al. | |
| 5,174,471 | A | 12/1992 | Kozlowski et al. | |
| 5,275,291 | A | 1/1994 | Sledge | |
| 5,657,901 | A | 8/1997 | Farside | |
| 5,782,359 | A | 7/1998 | McAllister et al. | |
| 5,816,441 | A | 10/1998 | Farside | |
| 5,897,025 | A | 4/1999 | Flewitt et al. | |
| 5,909,822 | A | 6/1999 | George et al. | |
| 5,915,560 | A | 6/1999 | George et al. | |
| 6,050,449 | A | 4/2000 | Kanj | |
| 6,131,765 | A | 10/2000 | Barry et al. | |
| 6,155,454 | A | 12/2000 | George et al. | |
| 6,267,265 | B1 | 7/2001 | Issa | |
| 6,382,460 | B1 | 5/2002 | Gonzalez | |
| 6,460,693 | B1 | 10/2002 | Harrold | |
| 6,527,138 | B2 | 3/2003 | Pawlo et al. | |
| 6,564,967 | B1 | 5/2003 | Stringfield et al. | |
| 6,641,031 | B2 | 11/2003 | Evans et al. | |
| 6,758,338 | B2 | 7/2004 | Lien | |
| 6,863,175 | B2 | 3/2005 | Gelardi | |
| 6,913,149 | B2 | 7/2005 | Gelardi et al. | |
| 6,976,576 | B2 | 12/2005 | Intini | |
| 7,159,720 | B2 | 1/2007 | Pearson | |
| 7,216,776 | B2 | 5/2007 | Gelardi | |
| 7,287,666 | B2 * | 10/2007 | De Laforcade | 221/65 |
| 7,320,413 | B2 | 1/2008 | Fusi | |
| 7,533,785 | B2 | 5/2009 | Smith | |
| 7,584,843 | B2 | 9/2009 | Kutsch et al. | |
| 7,740,132 | B2 | 6/2010 | Oono et al. | |
| 7,946,450 | B2 * | 5/2011 | Gelardi et al. | 221/154 |
| 2002/0175195 | A1 | 11/2002 | Cole | |
| 2003/0106900 | A1 | 6/2003 | Storz | |
| 2004/0074917 | A1 | 4/2004 | McHutchinson | |
| 2004/0217024 | A1 | 11/2004 | Arnarp et al. | |
| 2005/0011773 | A1 | 1/2005 | Intini | |
| 2005/0173272 | A1 | 8/2005 | Lemmons, IV | |
| 2005/0183981 | A1 | 8/2005 | Gelardi | |
| 2006/0060480 | A1 | 3/2006 | Budd | |
| 2006/0118589 | A1 | 6/2006 | Arnarp et al. | |
| 2006/0124658 | A1 | 6/2006 | Coe et al. | |
| 2006/0243611 | A1 | 11/2006 | Wu | |
| 2007/0068960 | A1 | 3/2007 | Valentine et al. | |
| 2007/0131704 | A1 * | 6/2007 | Ahedo et al. | 221/88 |
| 2007/0163911 | A1 | 7/2007 | Gelardi | |
| 2007/0246382 | A1 | 10/2007 | He | |
| 2007/0246383 | A1 | 10/2007 | He | |
| 2007/0277299 | A1 | 12/2007 | Kroon | |
| 2008/0029110 | A1 | 2/2008 | Dube et al. | |
| 2008/0029116 | A1 | 2/2008 | Robinson et al. | |
| 2008/0142535 | A1 | 6/2008 | Adler et al. | |
| 2009/0200332 | A1 | 8/2009 | Intini | |
| 2009/0223989 | A1 | 9/2009 | Gelardi | |
| 2010/0084424 | A1 | 4/2010 | Gelardi | |
| 2010/0133140 | A1 | 6/2010 | Bailey et al. | |

FOREIGN PATENT DOCUMENTS

| | | | |
|---|---|---|---|
| DE | 74 27 559 | U | 12/1974 |
| FR | 769822 | A | 9/1934 |
| GB | 2 042 476 | A | 9/1980 |
| WO | WO 99/48391 | A | 9/1999 |
| WO | WO 2004/035404 | A1 | 4/2004 |
| WO | WO 2004/037657 | A | 5/2004 |
| WO | WO 2005/016036 | A1 | 2/2005 |
| WO | WO 2005/028316 | A2 | 3/2005 |
| WO | WO 2005/030606 | A1 | 4/2005 |
| WO | WO 2005/035390 | A1 | 4/2005 |
| WO | WO 2007/017761 | A2 | 2/2007 |
| WO | WO 2007/067953 | A2 | 6/2007 |
| WO | WO 2007/070867 | A2 | 6/2007 |
| WO | WO 2008/070032 | A2 | 6/2008 |
| WO | WO 2009/055547 | A1 | 4/2009 |

* cited by examiner

DISPENSING CONTAINER FOR METERED DISPENSING OF PRODUCT

FIELD OF THE INVENTION

The present invention relates to containers and methods of use thereof. More particularly, the invention relates to containers that provide dispensing or dosing of the stored product.

BACKGROUND OF THE INVENTION

Various types of containers for dispensing solid objects, particularly solid products intended for human consumption, are known in the art. Such containers are often characterized by a hand-held size that can be easily stored and transported. Exemplary consumable products that are often packaged in such containers include pharmaceutical compositions, oral tobacco products, snacks, mints, gums, breath strips, candy, and the like.

Certain consumable products, such as pharmaceutical products, require containers having a certain level of child resistance. Traditionally, pills have been packaged in a bottle having a cap that can only be removed by applying downward pressure while twisting the cap. However, this type of child resistance has certain disadvantages. For example, if a child does manage to open the bottle, immediate access is provided to the entire contents of the bottle. Further, if an adult user fails to place the cap in the properly secured position, there is no secondary mechanism for preventing access by a child.

In addition to child resistance, another desirable feature for certain containers is the ability to dispense a metered amount of a product. In other words, it can be highly desirable for the container to control dispensing such that only a defined number of stored product units, such as only a single unit, is dispensed each time the container is opened. Metered distribution of a product can be advantageous as a further level of child resistance as it prevents unrestricted access to the entire contents of the container, and as a means to improve sanitation because such a container negates the need to touch numerous units within the container in order to obtain a single desired unit.

Exemplary containers that provide a locking mechanism for enhancing child-resistance of a container can be found, for example, in U.S. Pat. No. 6,863,175 to Gelardi; U.S. Pat. No. 6,913,149 to Gelardi et al.; U.S. Pat. No. 6,976,576 to Intini; and U.S. Pat. No. 7,216,776 to Gelardi, which are incorporated herein by reference in their entirety.

There remains a need in the art for a container for storing and dispensing a product capable of combining various advantageous features, such as child resistance, metered dispensing, and convenient size.

BRIEF SUMMARY OF THE INVENTION

The present invention provides a container that, in certain embodiments, combines child-resistance with metered dispensing, and which can be provided in a convenient handheld size. The type and form of the product to be stored and dispensed can vary, but rod-shaped products are particularly well-suited for use with the containers of the invention.

In one aspect, the invention provides a dispensing container comprising an outer casing having an open end, a top, a bottom, sidewalls extending between the top and bottom, and an interior compartment. The container also includes an inner tray slidably received within the interior compartment of the outer casing and comprising a storage compartment configured to store a plurality of units of product to be dispensed, and a dispensing trough in communication with the storage compartment, the inner tray extending outwardly from the open end of the outer casing and configured for sliding movement between a closed and locked position and a dispensing position. The dispensing trough comprises an aperture sized and configured to allow a single unit of product to exit the dispensing trough at one end thereof and a slot at the opposing end thereof. The outer casing further comprises a rib extending into the interior compartment and positioned to enter the slot of the dispensing trough as the inner tray slides between the dispensing position and the closed and locked position, the rib sized and configured to engage a unit of product within the dispensing trough as the inner tray slides towards the closed and locked position and urge the unit of product through the aperture of the dispensing trough.

The container may further comprise a locking mechanism adapted for releasably locking the inner tray in the closed and locked position within the outer casing, the locking mechanism comprising a depressible button in the top or bottom of the outer casing and a flexible locking plate attached to the inner tray, the depressible button being positioned to engage and deflect the flexible locking plate of the inner tray when depressed. The locking plate of the inner tray can include an aperture and the outer casing can include a projection adjacent to the depressible button and operatively positioned to engage the aperture of the locking plate when the inner tray is in the closed and locked position. In one embodiment, the projection has a beveled surface facing toward the open end of the outer casing.

In certain embodiments, the container further comprises a flexible tab extending into the dispensing trough adjacent to the aperture in the dispensing trough, the tab operatively positioned to engage a unit of product as the unit of product exits the dispensing trough. The inner tray of the container may also include a stop adapted for engaging the outer casing to prevent removal of the inner tray from the outer casing.

The inner tray can also include a raised surface adapted for grasping by a container user, the raised surface positioned to abut the top of the outer casing when the inner tray is in the closed and locked position. To further facilitate opening of the container, certain embodiments include a depression defined between the inner tray and the bottom of the outer casing when the inner tray is in the closed and locked position, the depression sized and configured to aid grasping of the inner tray.

In one embodiment, the container includes a recess in the outer casing sized and configured for receiving at least a portion of a unit of product dispensed from the dispensing container.

The storage compartment of the inner tray is preferably sized to accommodate a plurality of products. The products to be dispensed can have a variety of shapes, including pill, tablet, sphere, sheet, coin, cube, bead, ovoid, obloid, bean, stick, and rod. The types of products to be dispensed can also vary, and may include pharmaceutical products, smoking products, smokeless tobacco products, snack products, and confectionary products (e.g., candies, mints, and gums).

In another embodiment, the dispensing container comprises an outer casing having an open end, a top, a bottom, sidewalls extending between the top and bottom, and an interior compartment; as well as an inner tray slidably received within the interior compartment of the outer casing and comprising a storage compartment configured to store a plurality of units of product to be dispensed, and a dispensing trough in communication with the storage compartment, the inner tray configured for sliding movement between a closed and locked position and a dispensing position. The dispensing trough comprises an aperture sized and configured to allow a single unit of product to exit the dispensing trough at a first end of the dispensing trough facing the open end of the outer casing, and the dispensing trough further comprises a slot at an opposing end thereof. The container also includes a locking mechanism adapted for releasably locking the inner tray in the closed and locked position within the outer casing, the locking mechanism comprising a depressible button in the bottom of the outer casing, a projection extending from the bottom of the outer casing into the interior compartment proximal to the depressible button, and a flexible locking plate attached to the inner tray and facing the bottom of the outer casing. The flexible locking plate includes an aperture sized and configured to engage the projection when the inner tray is in the closed and locked position, and the depressible button is positioned to deflect the flexible locking plate of the inner tray away from the projection when depressed. A portion of the inner tray extends outwardly from the open end of the outer casing and comprises a raised surface adapted for grasping by a container user, the raised surface positioned to abut the top of the outer casing when the inner tray is in the closed and locked position. The outwardly-extending portion of the inner tray further comprises a bottom member that abuts the bottom of the outer casing, a depression sized and configured to aid grasping of the inner tray being defined between the bottom member of the outwardly-extending portion of the inner tray and the bottom of the outer casing. The outer casing further comprises a rib extending into the interior compartment from the bottom of the outer casing and positioned to enter the slot of the dispensing trough as the inner tray slides between the dispensing position and the closed and locked position, the rib sized and configured to engage a unit of product within the dispensing trough as the inner tray slides towards the closed and locked position and urge the unit of product through the aperture of the dispensing trough.

In another aspect, the invention provides a method of dispensing a product from a container, comprising providing a dispensing container according to any of the embodiments set forth herein with the inner tray in the closed and locked position; sliding the inner tray into the dispensing position; guiding a unit of product into the dispensing trough while the inner tray is in the dispensing position; sliding the inner tray into the closed and locked position such that, during said sliding step, the rib of the outer casing engages the slot of the dispensing trough and contacts the unit of product, urging the unit of product through the aperture in the dispensing trough and preventing further units of product from entering the dispensing trough; and removing the unit of product extending from the aperture in the dispensing trough. The dispensing container may further comprise a locking mechanism adapted for releasably locking the inner tray in the closed and locked position within the outer casing, the locking mechanism comprising a depressible button in the top or bottom of the outer casing and a flexible locking plate attached to the inner tray, the depressible button positioned to engage and deflect the flexible locking plate of the inner tray when depressed. Where such a locking mechanism is present, the method of dispensing a product further comprises depressing the button to unlock the dispensing container prior to sliding the inner tray into the dispensing position.

BRIEF DESCRIPTION OF THE DRAWINGS

Figure 1:
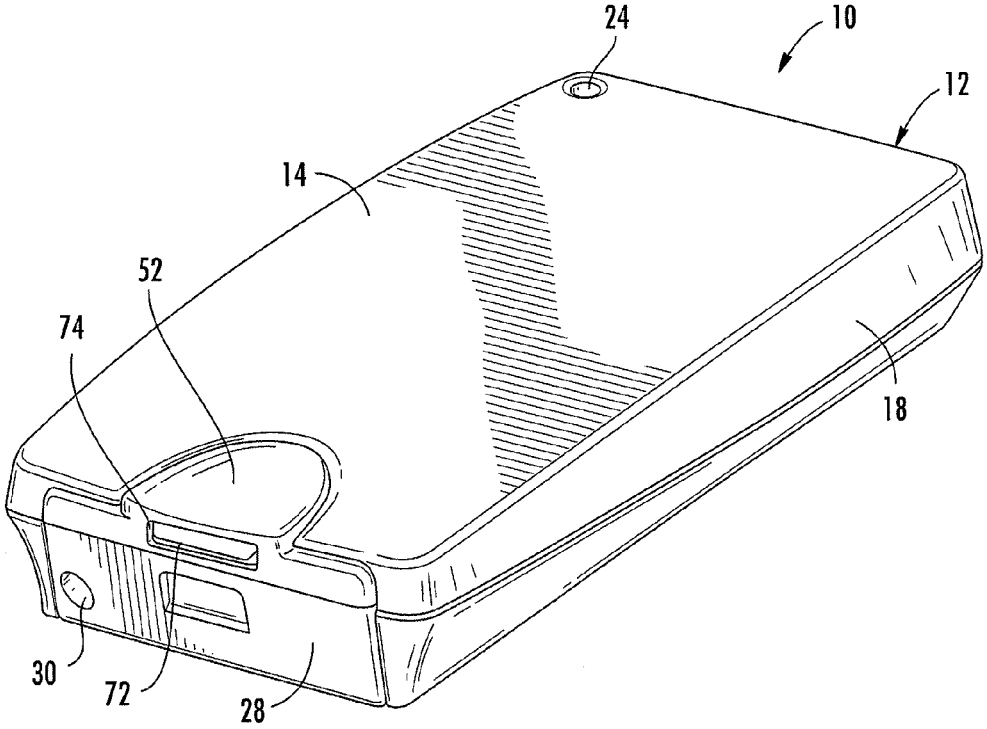
Figure 2:
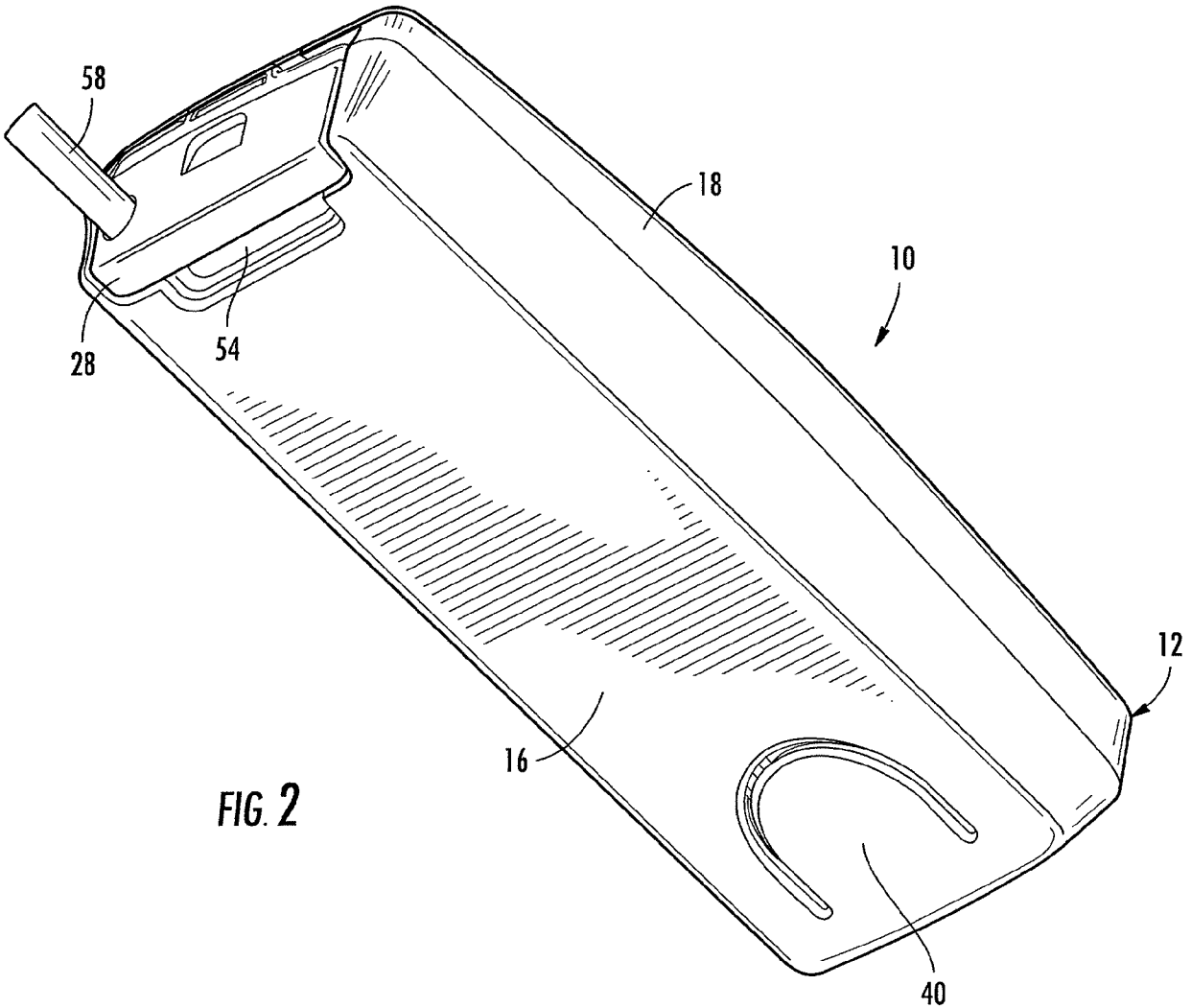
Figure 3A:
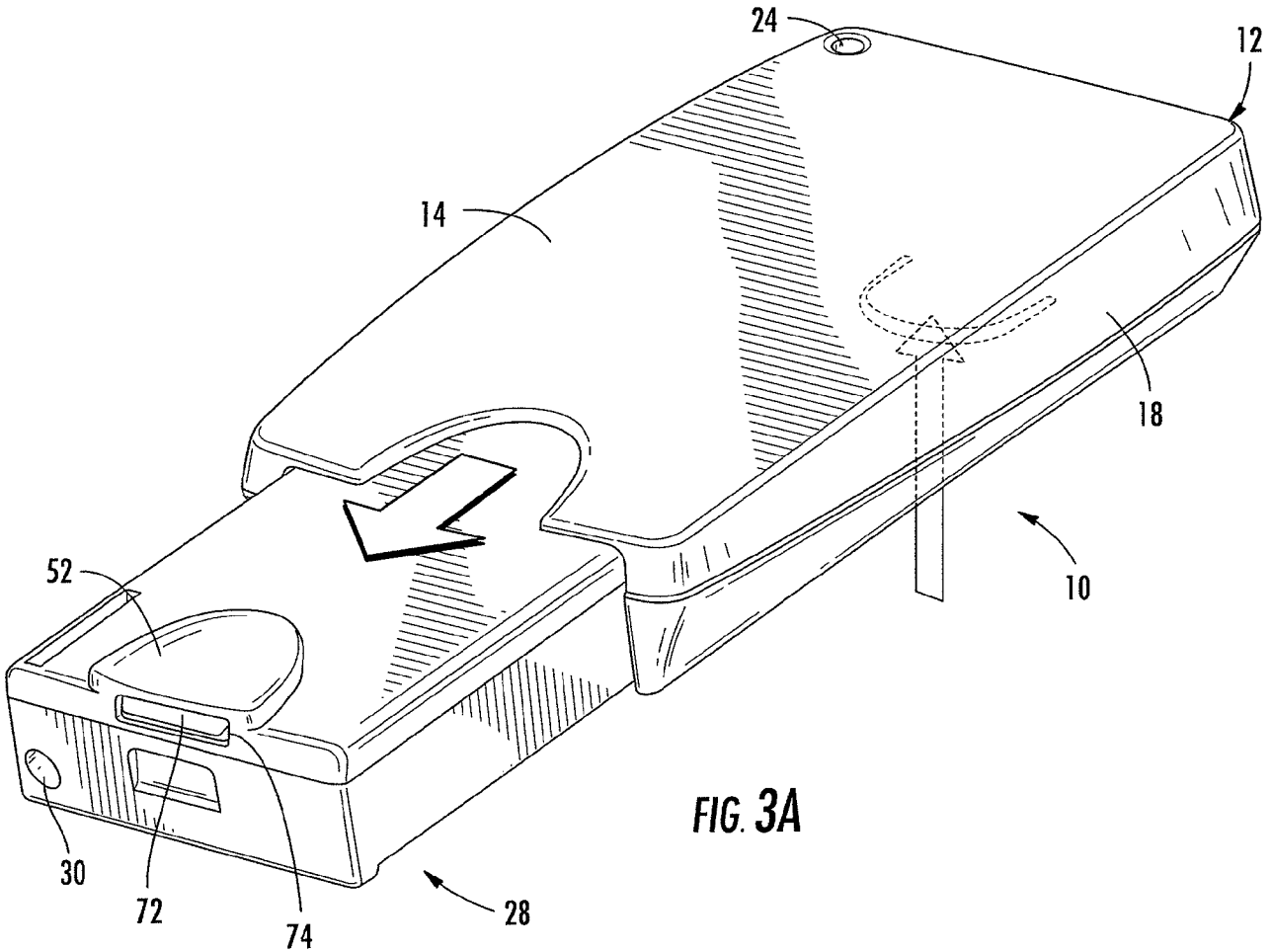
Figure 3B:
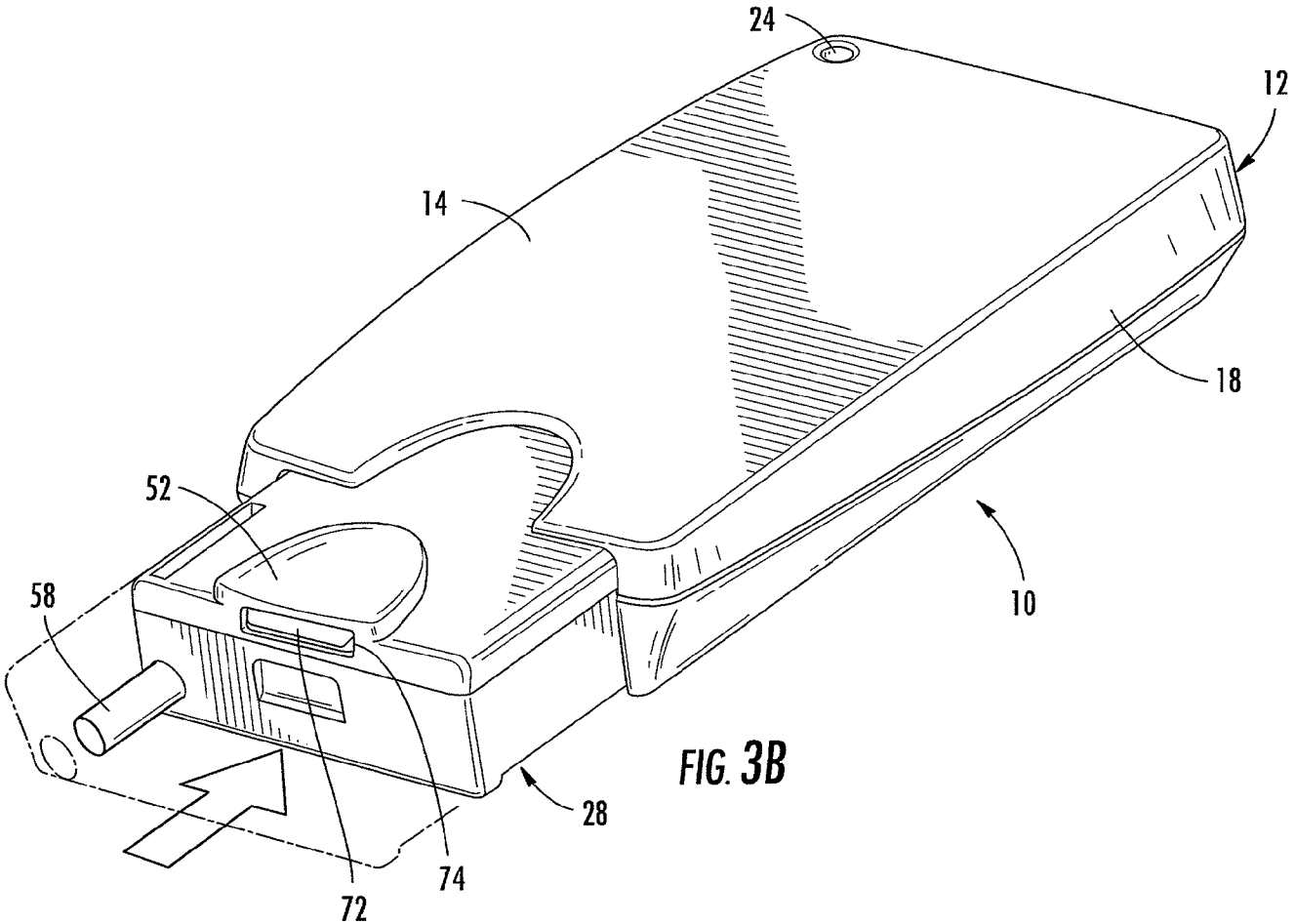
Figure 3C:
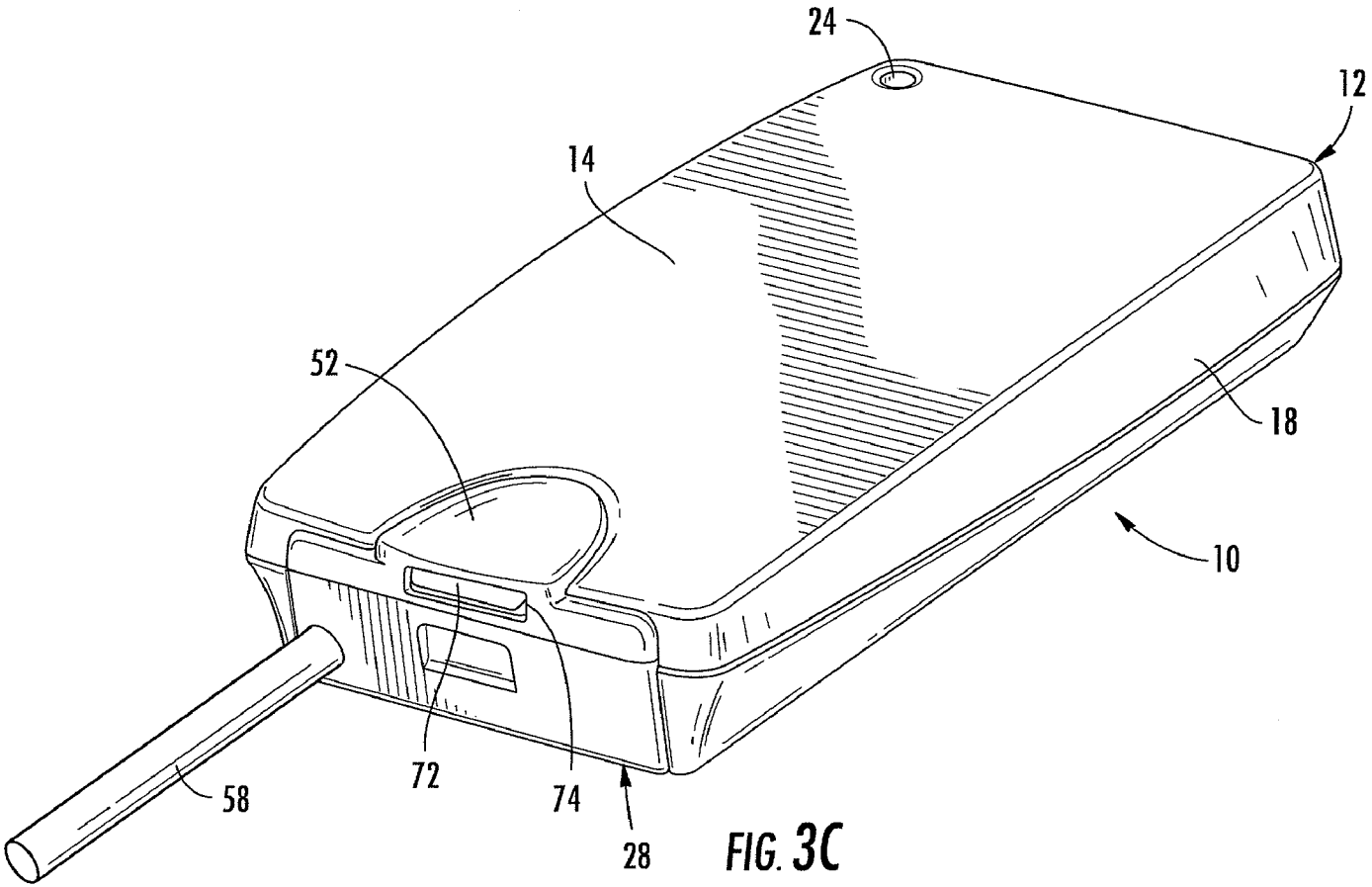
Figure 4:
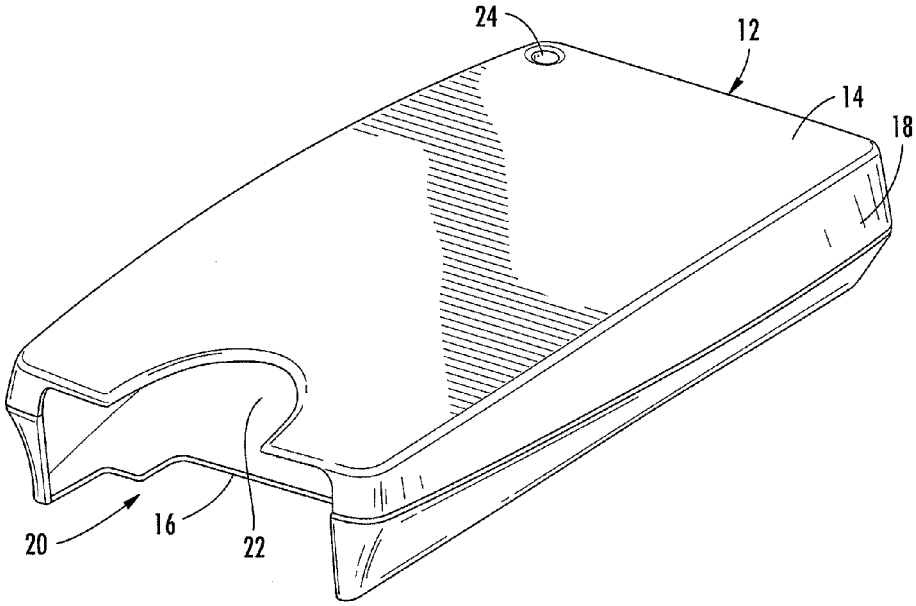
Figure 5:
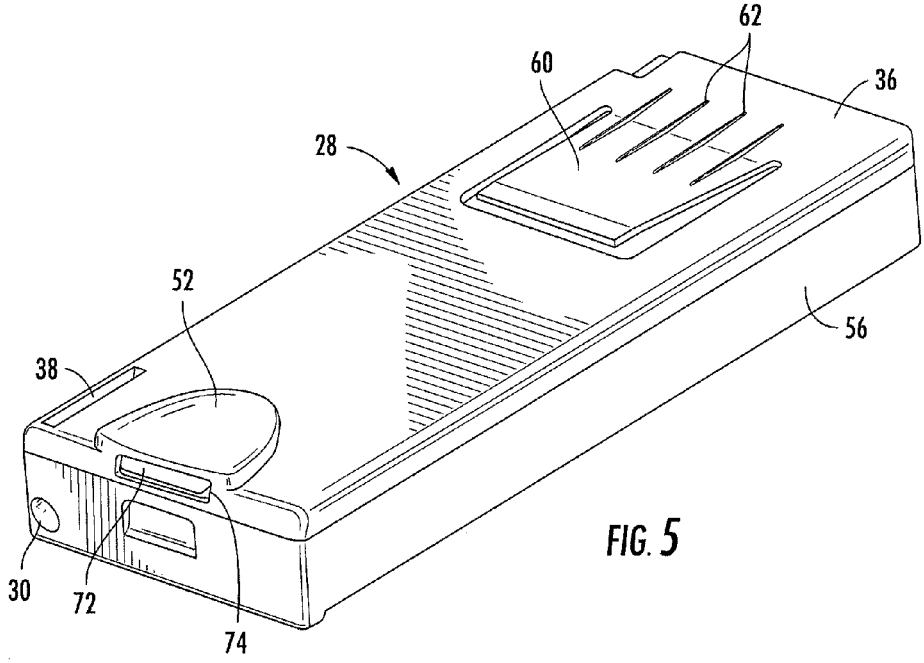
Figure 6:
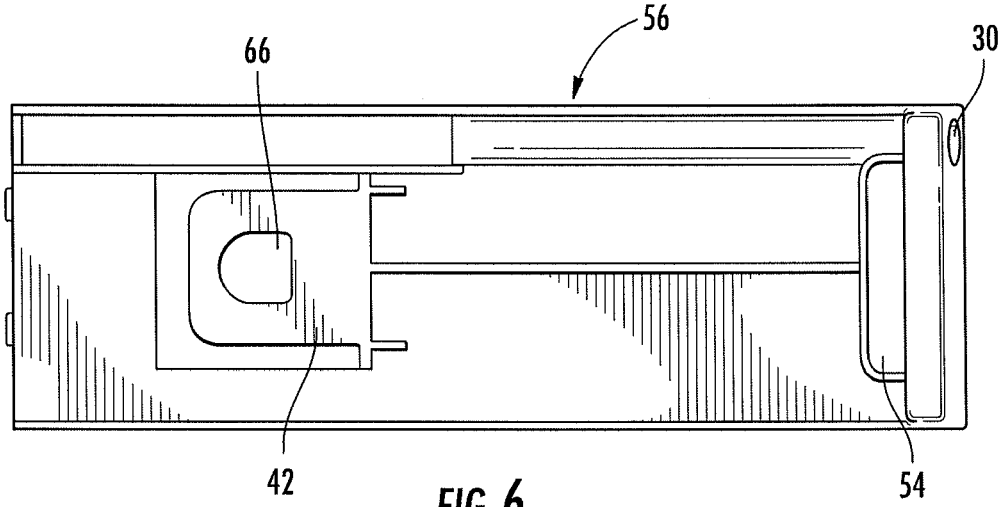
Figure 7:
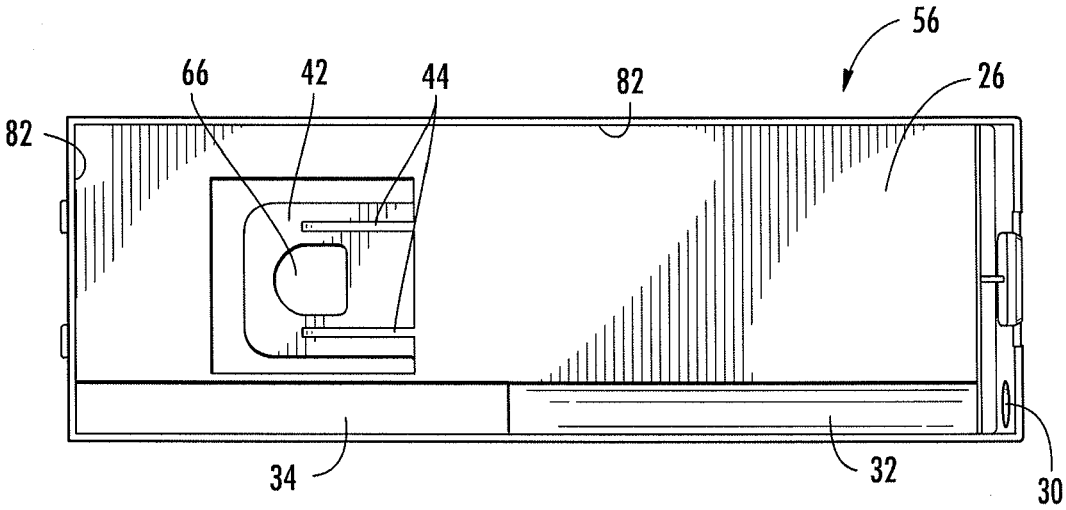
Figure 8:
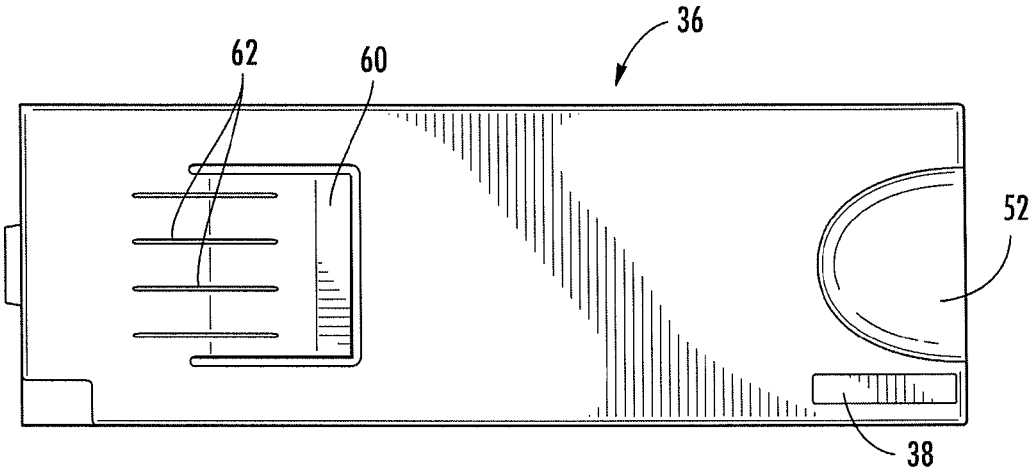
Figure 9:
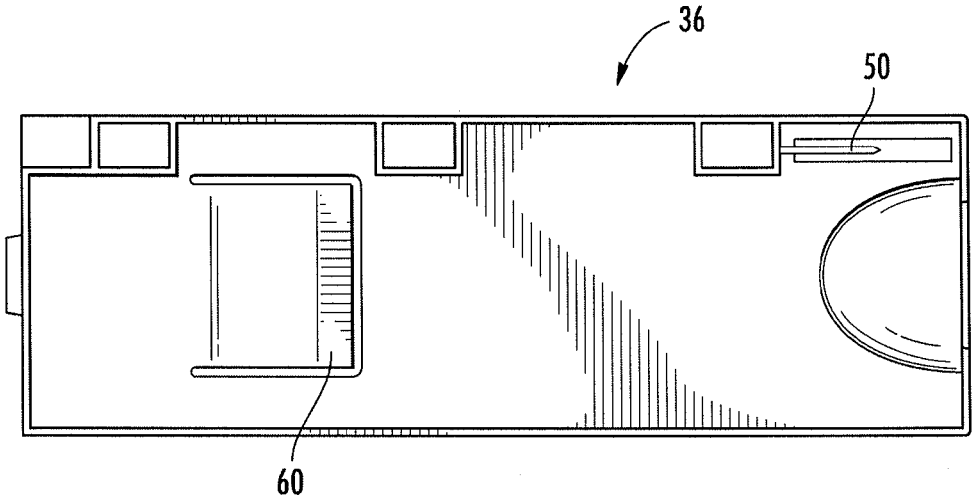
Figure 10:
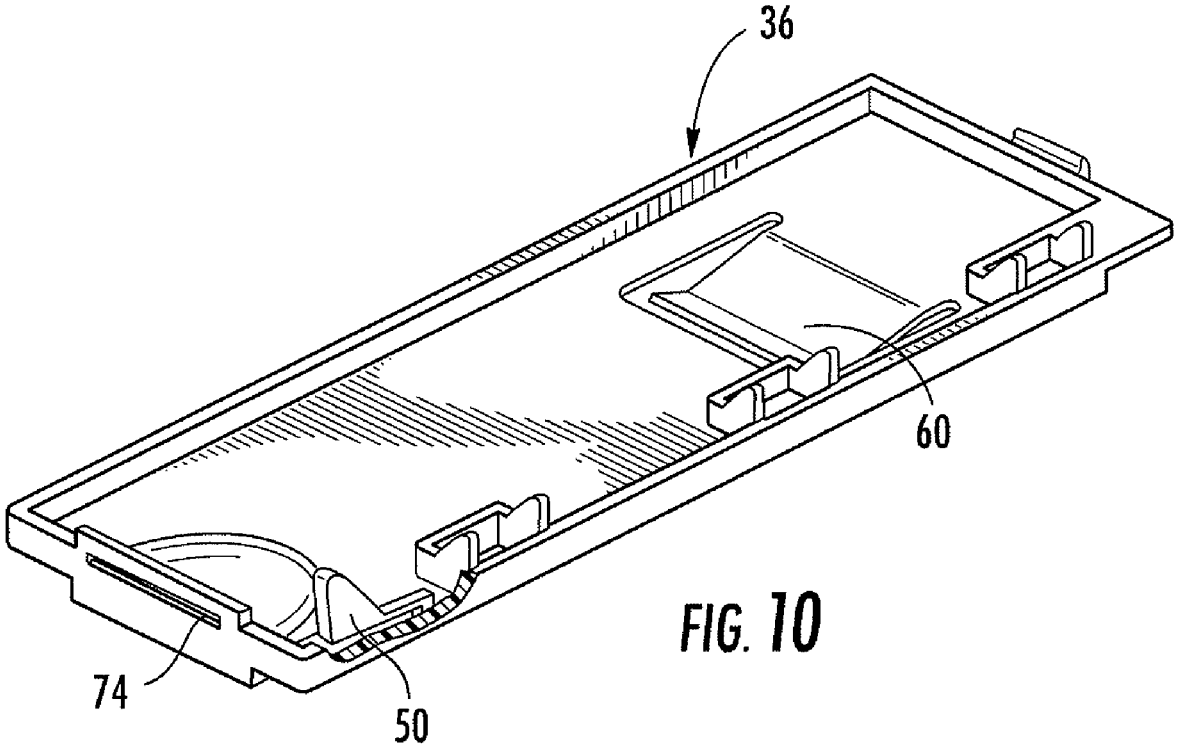
Figure 11:
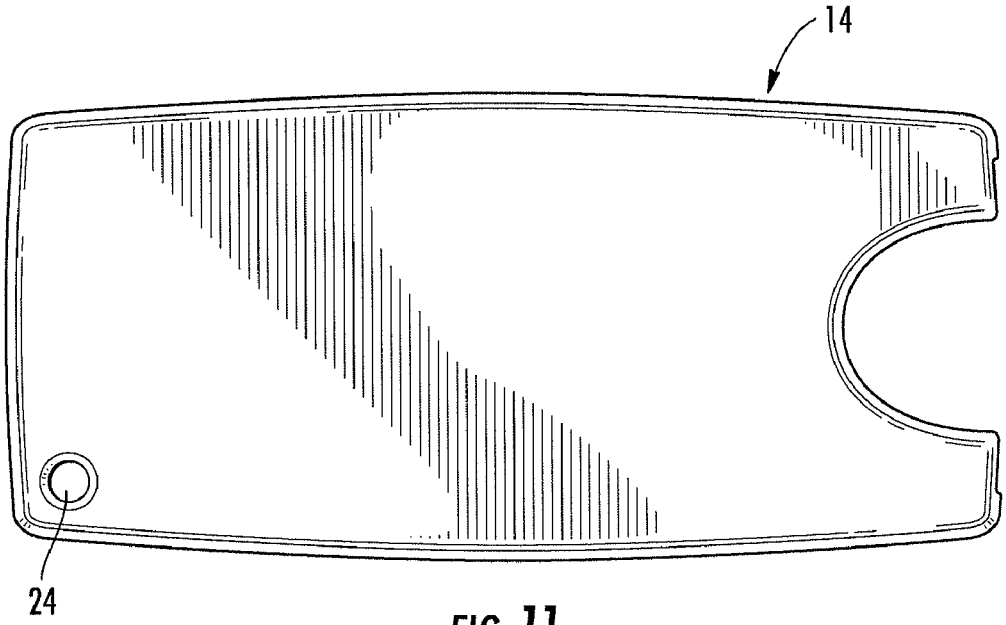
Figure 12:
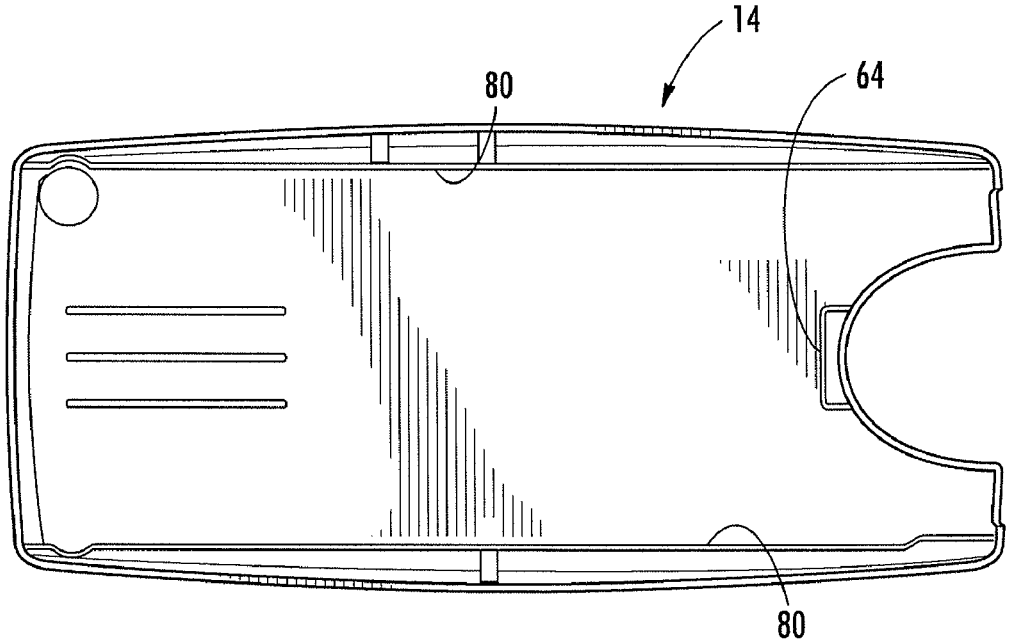
Figure 13:
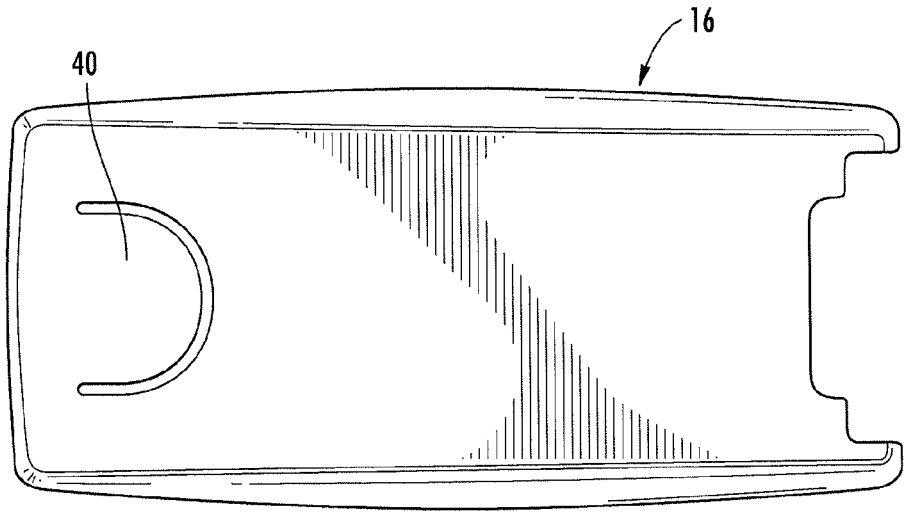
Figure 14:
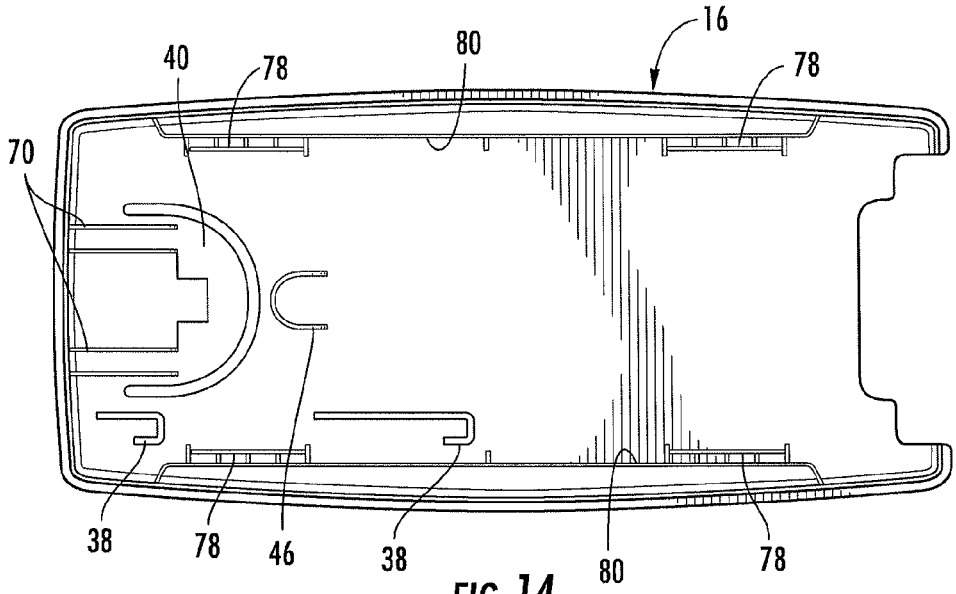
Figure 15:
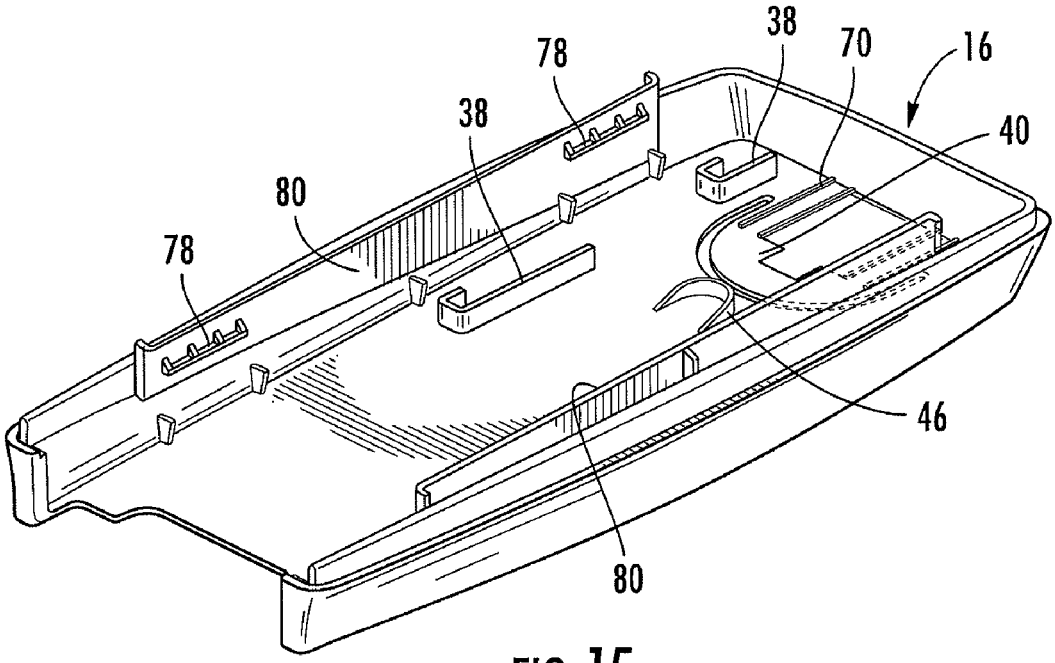
Figure 16A:
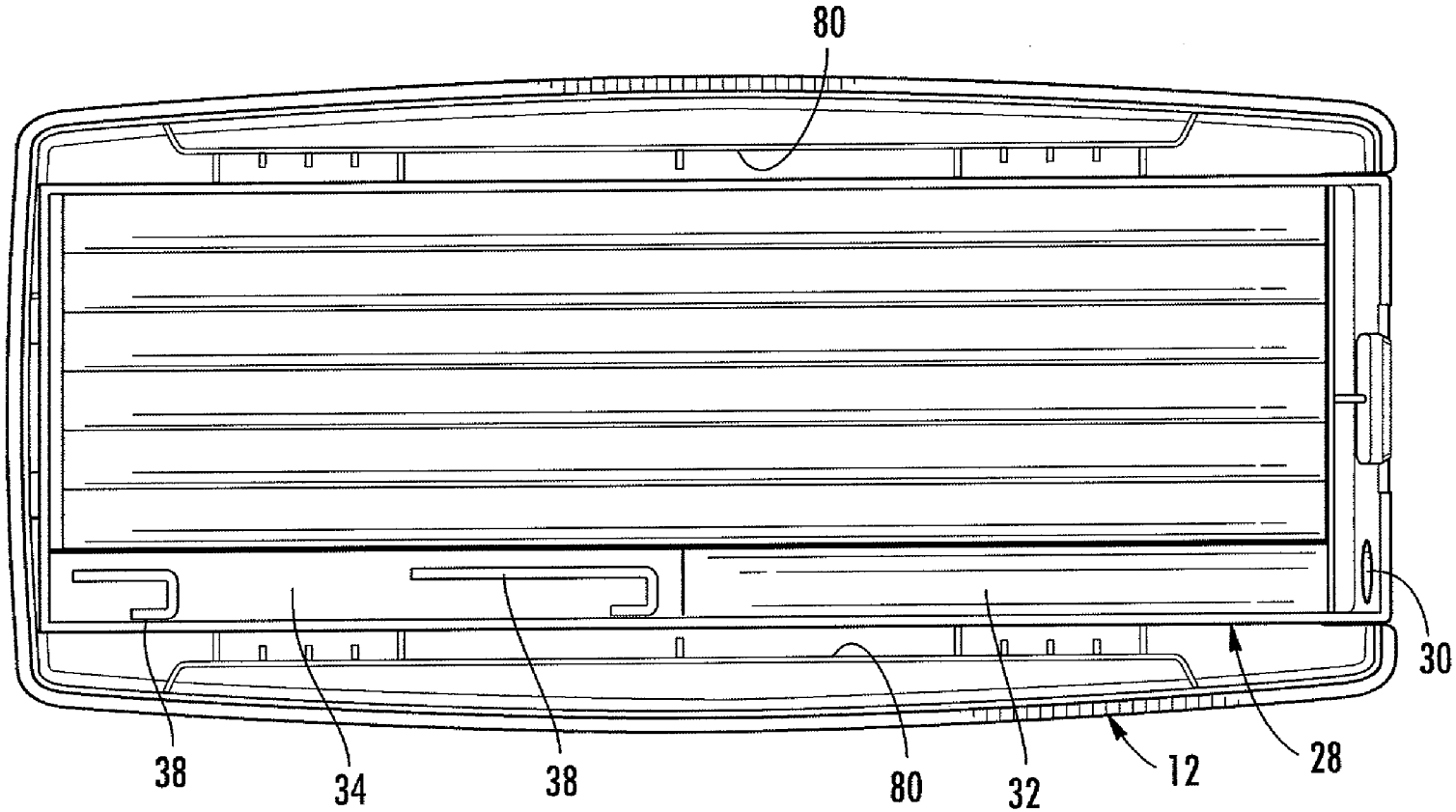
Figure 16B:
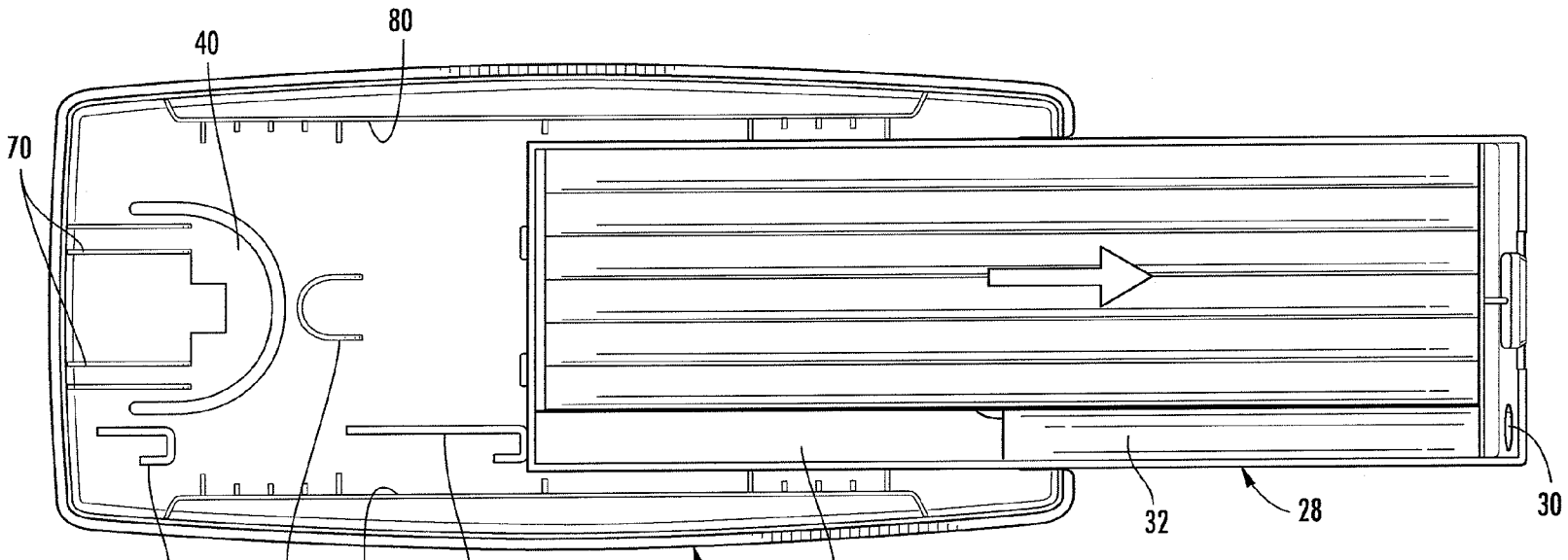
Figure 16C:
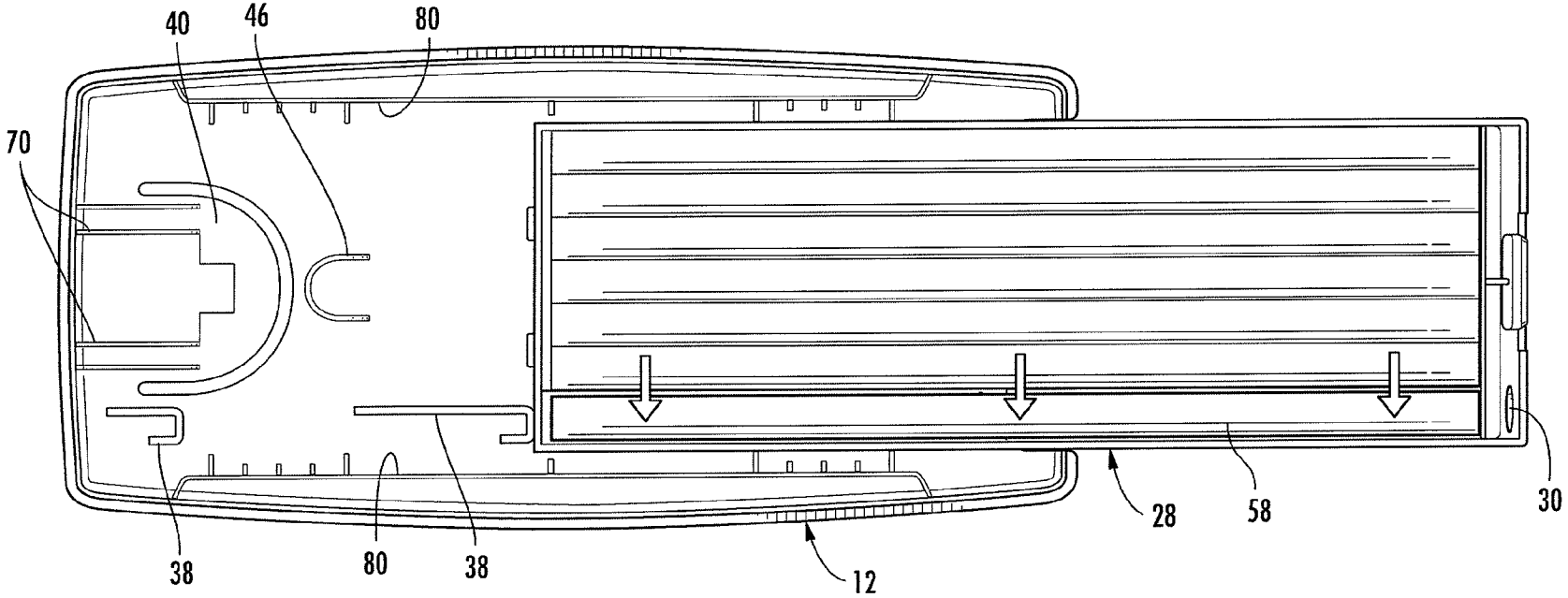
Figure 16D:
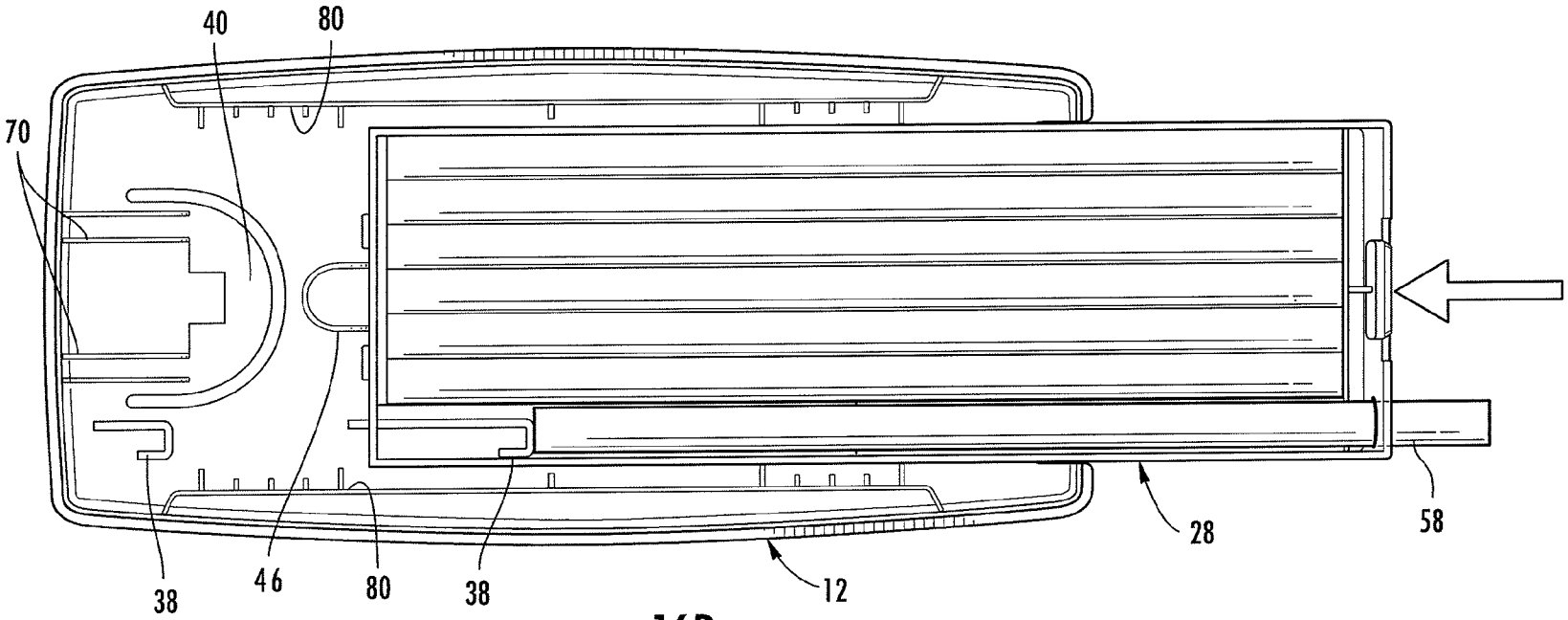
Figure 16E:
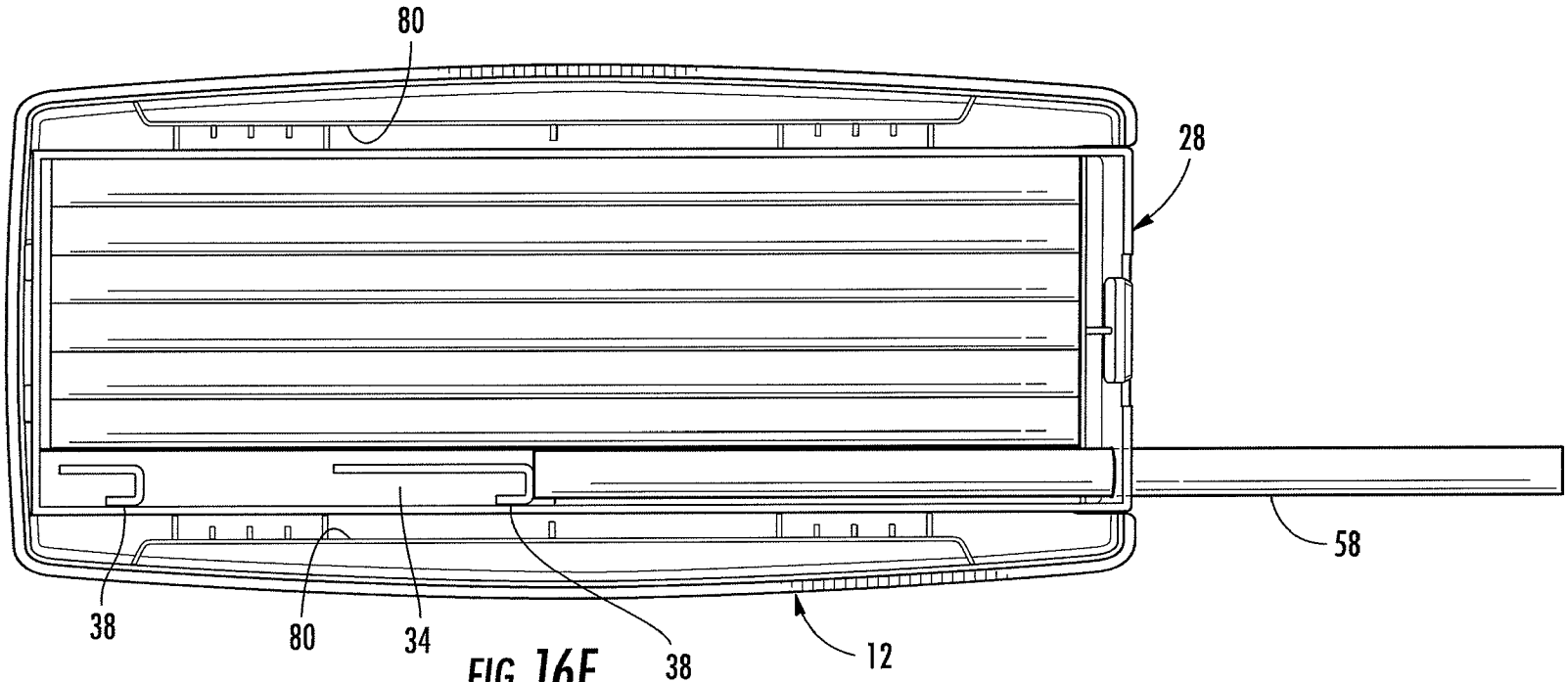

Having thus described the invention in general terms, reference will now be made to the accompanying drawings, which are not necessarily drawn to scale, and wherein:

FIG. 1 is a perspective view of a container embodiment of the invention facing the top surface thereof;

FIG. 2 is a perspective view of the container embodiment of FIG. 1 facing the bottom surface thereof;

FIGS. 3A-3C provide a perspective view of the container embodiment of FIG. 1 moving between the closed and locked position and the dispensing position;

FIG. 4 is perspective view of a the outer casing of the container embodiment of FIG. 1;

FIG. 5 is a perspective view of the dispensing tray of the container embodiment of FIG. 1;

FIGS. 6 and 7 are views of a bottom portion of the dispensing tray of FIG. 5 facing the exterior surface and the interior surface thereof, respectively;

FIGS. 8 and 9 are views of the top portion of the dispensing tray of FIG. 5 facing the exterior surface and the interior surface thereof, respectively;

FIG. 10 is a perspective view of the top portion of the dispensing tray of FIG. 5 facing the interior surface thereof, FIGS. 11 and 12 are views of the top portion of the outer casing of FIG. 4 facing the exterior surface and the interior surface thereof, respectively;

FIGS. 13 and 14 are views of the bottom portion of the outer casing of FIG. 4 facing the exterior surface and the interior surface thereof, respectively;

FIG. 15 is a perspective view of the bottom portion of the outer casing of FIG. 4 facing the interior surface thereof, and FIGS. 16A-16E illustrate operation of a container embodiment of the invention with the top portion of the dispensing tray and the top portion of the outer casing removed.

DETAILED DESCRIPTION OF THE INVENTION

The present invention now will be described more fully hereinafter with reference to certain preferred embodiments. These embodiments are provided so that this disclosure will be thorough and complete, and will fully convey the scope of the invention to those skilled in the art. Indeed, the invention may be embodied in many different forms and should not be construed as limited to the embodiments set forth herein; rather, these embodiments are provided so that this disclosure will satisfy applicable legal requirements. As used in the specification, and in the appended claims, the singular forms "a", "an", "the", include plural referents unless the context clearly dictates otherwise.

The container embodiments described in the present application can be used to store and dispense any solid products, but are particularly well-suited for products designed for oral consumption. Exemplary consumable products include pharmaceutical products such as pills and tablets, cigarettes and other smoking products, smokeless tobacco products, candies, mints, gums and other confectionary products, snacks, and the like.

Exemplary tobacco products include pelletized tobacco products (e.g., compressed or molded pellets produced from powdered or processed tobacco, such as those formed into the general shape of a coin, cylinder, bean, pellet, sphere, obloid, cube, bead, or the like), extruded or cast pieces of tobacco (e.g., as strips, films or sheets, including multilayered films formed into a desired shape), products incorporating tobacco carried by a solid substrate (e.g., where substrate materials range from edible grains to inedible cellulosic sticks), extruded or formed tobacco-containing rods or sticks, tobacco-containing capsule-like materials having an outer shell region and an inner core region, straw-like (e.g., hollow formed) tobacco-containing shapes, sachets or packets containing tobacco (e.g., snus-like products), pieces of tobacco-containing gum, and the like.

Exemplary smokeless tobacco compositions that can be packaged in the containers of the invention are set forth in, for example, U.S. Pat. No. 1,376,586 to Schwartz; U.S. Pat. No. 3,368,567 to Speer; U.S. Pat. No. 4,513,756 to Pittman et al.; U.S. Pat. No. 4,606,357 to Dusek et al; U.S. Pat. No. 4,821,749 to Toft et al.; U.S. Pat. No. 5,167,244 to Kjerstad; U.S. Pat. No. 5,387,416 to White; U.S. Pat. No. 6,668,839 to Williams; US 2005/0244521 to Strickland et al.; US 2006/0191548 to Strickland et al.; US 2007/0186942 to Strickland et al.; US 2008/0029110 to Dube et al.; and US 2008/0029116 to Robinson et al. Examples of tobacco-containing gum are set forth in U.S. Pat. No. 4,624,269 to Story et al.; U.S. Pat. No. 4,975,270 to Kehoe; and U.S. Pat. No. 4,802,498 to Ogren. Various manners or methods for packaging smokeless tobacco products are set forth in US 2004/0217024 and US 2006/0118589 to Amarp et al.; WO 2005/016036 to Bjorkholm; WO 2006/034450 to Budd; WO 2007/017761 to Kutsch et al.; and WO 2007/067953 to Sheveley et al. All of the above-cited references are incorporated by reference herein in their entirety.

Smokeless tobacco compositions utilized as the product contained in the containers of the invention will often include such ingredients as tobacco (typically in particulate form), sweeteners, binders, colorants, pH adjusters, fillers, flavoring agents, disintegration aids, antioxidants, oral care additives, and preservatives. See, for example, US 2007/0186941 to Holton et al., which is incorporated by reference herein in its entirety.

The size and shape of the product to be stored and dispensed can vary. Exemplary product shapes include pills, tablets, spheres, strips, films, sheets, coins, cubes, beads, ovoids, obloids, cylinders, bean-shaped, sticks, or rods. Cross-sectional shape of the products can vary, and exemplary cross-sectional shapes include circles, squares, ovals, rectangles, and the like. The dimensions of the product will often vary depending on its shape. In one embodiment, the product is rod-shaped with a length in the range of about 50 to about 100 mm (more typically about 60 to about 80 mm) and a diameter of about 2 mm to about 8 mm (more typically about 3 mm to about 6 mm).

The shape of the outer surface of the containers of the invention can vary. Although the container embodiments illustrated in the drawings have certain contours, containers with other exterior surface designs could also be used. For example, the sides or edges of the containers of the invention could be flattened, rounded, or beveled, and the various surfaces or edges of the container exterior could be concave or convex. Further, the opposing sides, ends, or edges of the container can be parallel or non-parallel such that the container becomes narrower in one or more dimensions.

The dimensions of the containers described herein can vary without departing from the invention. However, in preferred embodiments, the containers of the invention can be described as having a size suitable for handheld manipulation and operation. Exemplary dimensions for such handheld embodiments include lengths in the range of about 25 mm to about 200 mm, more typically about 50 mm to about 150 mm, and most often about 80 mm to about 120 mm. Exemplary widths include the range of about 10 mm to about 100 mm, more typically about 20 mm to about 80 mm, and most often about 30 mm to about 60 mm. As used herein, length and width refer to the major dimensions of the container that define the major plane of the container. Exemplary depths for handheld container embodiments of the invention range from about 5 mm to about 50 mm, more typically about 8 mm to about 30 mm, and most often about 10 mm to about 20 mm.

The number of solid product units stored in the containers of the invention can also vary, depending on the size of the container and the size of the product units. Typically, the number of stored product units will vary from about 5 to about 100, more typically about 10 to about 50, and most often about 15 to about 30.

The material of construction of the container can also vary. Exemplary materials include metal, wood, and synthetic plastic materials. Polymeric materials that can be extruded and/or molded into desired shapes are typically utilized, such as polyethylene, polystyrene, polyamide, and the like.

In certain embodiments, the containers of the invention combine several advantageous features, such as child-resistance and metered dispensing of a product. In particular, certain embodiments of the containers of the invention include a child-resistant locking mechanism that releasably locks an inner tray of the container in a closed and locked position. The locking mechanism can be released and a product dispensed using a series of manipulations including, for example, depressing a locking button and sliding an inner tray to expose the product to be dispensed. The containers of the invention provide, in certain embodiments, metered dispensing of the product by providing a dispensing trough sized for passage of a single unit of the product so that only a single unit of product can enter the dispensing trough at one time.

Certain preferred embodiments of the invention are described herein as providing metered dispensing of a single unit of product, which can be, for example, a single consumable unit of a smokeless tobacco product, a single consumable unit of a confectionary or snack product, or a single dosage unit of a pharmaceutical product. However, the invention encompasses embodiments where the product is dispensed in greater amounts, such as a plurality of units. For example, the dispensing aperture and dispensing trough described herein could be sized to provide space for more than one unit of product if desired.

FIGS. 1-16 illustrate a container embodiment 10 that is particularly well-suited for storage and dispensing of a product having a rod or cylindrical shape. FIGS. 1 and 2 provide a perspective view of a container embodiment 10 in a closed and locked position. The container 10 includes an outer casing 12, the outer casing including a top 14, a bottom 16, and side walls 18. As shown in FIG. 4, the outer casing 12 includes an open end 20 that provides access to an interior compartment 22. Referring back to FIG. 1, an inner tray 28 is received within the interior compartment 22 of the outer casing 12. Although the illustrated embodiment of the outer casing 12 and the inner tray 28 each comprise two separate interlocking pieces, the outer casing and/or inner tray could have a unitary structure or comprises more than two interlocking pieces if desired.

Referring to FIG. 2, the bottom 16 of the outer casing 12 includes a depressible button 40 and has a cutout section shaped to receive the lower edge of the inner tray 28 while maintaining a depression 54 between the bottom of the outer casing and the inner tray. The depression 54 provides a convenient place for grasping of the inner tray 28 by the user. For example, the depression is advantageously sized to accommodate a fingernail or fingertip of the user for purposes of grasping the inner tray.

The inner tray 28 also includes a raised surface 52 shaped in a manner that corresponds to a cutout in the top 14 of the outer casing 12. The raised surface 52 is sized and configured for abutting contact with the corresponding shaped cutout in the top 14 of the outer casing 12. Although the illustrated embodiment of the raised surface 52 has a semi-circular leading edge that abuts the outer casing 12, any cross-sectional shape can be utilized without departing from the invention. The raised surface 52 provides a convenient location for the user to place a finger for grasping the inner tray in order to slide the tray from the outer casing 12.

As shown in FIGS. 3A-3C, in operation, certain embodiments of the container 10 of the invention provide a locking mechanism adapted to provide a certain level of child resistance, and also provide metered dispensing of a product. As shown in FIG. 3A, in one embodiment, depressing a button 40 on the bottom 16 of the outer casing 12 allows the inner tray 28 to slide from a closed and locked position within the interior compartment 22 of the outer casing to a dispensing position wherein a portion of the inner tray has been removed from the outer casing. From this unlocked position, the container 10 can be manipulated by the user in order to urge a single unit of product stored within the inner tray to drop into a dispensing trough described in greater detail below. Once a unit of product is within the dispensing trough, as shown in FIG. 3B, the user may push the inner tray 28 towards the closed and locked position, which results in the unit of product 58 exiting a dispensing aperture 30 that communicates with the dispensing trough within the inner tray. As shown in FIG. 3C, once the inner tray is again in the closed and locked position within the interior compartment 22 of the outer casing 12, a significant portion of a unit of product 58 has extended through the dispensing aperture 30 and can be grasped and removed by the user.

FIGS. 4 and 5 provide perspective views of the outer casing 12 and the inner tray 28, respectively. As also shown in FIG. 5, the inner tray 28 includes a stop 60 in the form of a section of the top 36 of the inner tray having three sides detached from the remainder of the top of the inner tray, the stop having a raised profile above the surface of the top of the inner tray. In order to increase the rigidity of the stop 60, the inner tray 28 may further include one or more strengthening ribs 62, which maintain the stop in a raised position above the surface of the top 36 of the inner tray. The stop 60 of the inner tray 28 is sized and configured to engage a projecting lip 64 near the open end 20 of the outer casing 12 (see FIG. 12). Interaction between the stop 60 and the projecting lip 64 of the top 14 of the outer casing 12 prevents complete removal of the inner tray 28 from the outer casing as the inner tray slides towards the dispensing position.

FIGS. 6 and 7 provide a view of the exterior surface and the interior surface, respectively, of the bottom 56 of the inner tray 28. In FIG. 6, a flexible locking plate 42 is shown, the locking plate including an aperture 66. The locking plate 42 interacts with the corresponding locking mechanism elements of the outer casing 12 shown in FIG. 14. As also shown in FIG. 6, the bottom surface of the bottom 56 of the inner tray 28 provides a depression 54 that is sized and configured to aid the grasping of the inner tray as a user slides the inner tray between the closed and locked position and the open, dispensing position. As shown in FIG. 7, the locking plate 42 can include one or more strengthening ribs 44 that aid in prevention of permanent deformation of the flexible locking plate after repeated use.

FIG. 7 illustrates a bottom 56 of the inner tray 28 facing the interior of the inner tray, the bottom including side walls 82 that partially define the storage compartment 26 contained within the inner tray. A dispensing trough 32 is positioned adjacent to the storage compartment 26 and aligned with dispensing aperture 30. The trough 32 defines a depression below the surface of the storage compartment 26 such that manipulation of the container 10 while the inner tray 28 is in the dispensing position will result in urging of a unit of product into the dispensing trough. Since the dispensing trough is sized and configured to hold only a single unit of product, the container 10 is capable of metered dispensing of the stored product one unit at a time. The dispensing trough is preferably located laterally in relation to the storage compartment 26 and, where a rod-shaped product is to be dispensed, can extend longitudinally along the entire length of the storage compartment. As also shown in FIG. 7, the end of the dispensing trough 32 opposite the dispensing aperture 30 includes a slot 34. The slot 34 is designed to allow passage of the one or more ribs 38 discussed below into the dispensing trough 32. As shown, the slot can extend longitudinally along a significant portion of the length of the dispensing trough 32 such that the dispensing trough is only floored along a portion of its length. The slot 34 also extends into the rear sidewall of the bottom 56.

FIGS. 8 and 9 provide an exterior view and an interior view of the top 36 of the inner tray 28. The top 36 of the inner tray 28 includes the raised stop 60 as well as one or more optional strengthening ribs 62 that help maintain the stop in its raised position above the surface of the top of the inner tray. The raised surface 52 designed to aid grasping of the inner tray 28 is also shown in FIG. 8. The top surface of the top 36 of the inner tray also includes a rectangular aperture 38 designed to accommodate flexing movement of a tab 50 shown in FIG. 9. The tab 50 is a thin, flexible projecting member positioned to engage a unit of product as it slides through the dispensing aperture 30. The position of the tab 50 allows the tab to engage the top of the unit of product as the unit of product slides through the dispensing trough 32 and out the dispensing aperture 30. Interaction with the unit of product causes the tab to deflect upward, and the aperture 38 is present to accommodate the upward movement of the tab. The purpose of the tab 50 is to provide frictional contact with the unit of product as it moves through the dispensing aperture 30, thereby moderating the speed of the unit of product as it is dispensed. The tab 50 can also serve to block attempted reentry of a unit of product into the dispensing trough as the tab is located adjacent to the dispensing aperture 30 and positioned such that at least a portion of the tab blocks the aperture when no unit of product is exiting the dispensing aperture. Although the size and shape of the tab 50 can be altered without departing from the invention, in one preferred embodiment shown in FIG. 10, the stop has a longitudinally extending arm portion ending in a roughly triangular shaped tip with one corner of the triangle projecting downward toward the dispensing trough 32.

FIGS. 11 and 12 provide external and internal views, respectively, of the top 14 of the outer casing 12. As discussed previously, the interior surface of the top 14 includes a projecting lip 64 positioned to engage the stop 60 of the inner tray 28 as the tray slides out from the interior compartment 22 of the outer casing. Abutting contact between the stop 60 and the projecting lip 64 prevents continuation of the sliding movement of the inner tray 28 so that the inner tray can be retained within the outer casing 12. As also shown in FIG. 11, in one embodiment, the top 14 of the outer casing 12 includes an aperture or recess 24 sized and configured for retention of a dispensed unit of product by the user. This aperture 24 could be useful, for instance, where the user has not finished with the dispensed unit of product and desires a convenient place to store the partially used product for a period of time. The aperture is placed so as to avoid interference with the sliding engagement of the inner tray 28 within the outer casing 12.

FIGS. 13 and 14 provide an exterior view and an interior view, respectively, of the bottom 16 of the outer casing 12. As shown in FIG. 13, the outer surface of the bottom 16 includes a depressible button 40, which is a component of the locking mechanism for the container 10. The depressible button 40 is defined by a semi-circular cut that weakens a portion of the bottom 16 and increases the flexibility of the button. The underside of the button 40 can include one or more strengthening ribs 70 adapted to strengthen the button 40 and prevent permanent deformation of the button after repeated use. The locking mechanism further includes a projection 46 adjacent to the depressible button 40. As shown in FIG. 15, the projection 46 preferably includes a beveled surface facing the open end 20 of the outer casing 12. The beveled surface facilitates sliding of the bottom surface of the inner tray 28, as well as the locking plate 42, over the projection 46 as the inner tray slides into the closed and locked position. The projection 46 is sized for engagement within the aperture 66 of the locking plate 42 of the inner tray 28 when the inner tray is in the closed and locked position. The size and shape of the projection 46 and the corresponding aperture 66 can vary without departing from the invention.

While in the closed and locked position, the locking plate 42 is positioned overlying the flexible button 40. As a result, depressing button 40 toward the interior of the container 10 will result in engagement with the locking plate 42. Sufficient flexing of the locking plate 42 toward the interior of the inner tray 28 will cause disengagement of the projection 46 from the aperture 66 within the locking plate 42. Once the aperture 66 is clear of the projection 46, the user can freely slide the inner tray 28 toward the dispensing position.

As also shown in FIGS. 14 and 15, the interior of the bottom 16 of the outer casing 12 includes one or more ribs 38 positioned to engage the slot 34 at the rear of the dispensing trough 32 of the inner tray 28. As illustrated, the ribs 38 are configured with a leading surface positioned to engage a unit of product within the dispensing trough 32. Interaction between the rib 38 and the unit of product is best shown in FIGS. 13A-13E described below. The number, shape, and size of the ribs 38 can vary without departing from the present invention. Although hook-shaped ribs are illustrated herein, other rib configurations could be used that provide a surface for contacting a unit of product and serve to block entry of a unit of product into the dispensing trough when the container is in the closed and locked position.

FIGS. 13A-13E illustrate the interaction between the rib 38 of the bottom 16 of the outer casing 12 with the slot 34 in the inner tray 28 and a unit of product 58 dispensed from the inner tray. These figures illustrate a container embodiment 10 with both the top 14 of the outer casing 12 and the top 36 of the inner tray 28 removed for ease of viewing. FIG. 13A illustrates the container in its closed and locked position. As shown, the one or more ribs 38 are positioned within the slot 34. The presence of the one or more ribs 38 within the slot 34 prevents a unit of product from exiting the storage compartment 26 and entering the dispensing trough 32. FIG. 13B illustrates movement of the inner tray 28 toward the dispensing position following unlocking of the container 10. As shown, sliding of the inner tray 28 toward the exterior of the container 10 results in disengagement between the ribs 38 and the slot 34 in the dispensing trough 32. While in the dispensing position, as shown in FIG. 13C, the user of the container may manipulate the container until a unit of product 58 is urged into the dispensing trough 32. As shown in FIG. 13D, the user can then slide the inner tray 28 back toward the closed and locked position. However, with a unit of product 58 in the dispensing trough 32, sliding of the inner tray 28 back toward the closed and locked position results in abutting contact between one end of the unit of product and the first rib 38 of the outer casing 12. As the inner tray continues to slide towards the closed and locked position, the contact between the rib 38 and the unit of product 58 causes the unit of product to exit the dispensing aperture 30 and become visible to the user. Once the container 10 is in the closed and locked position, the user may grasp the unit of product 58 and remove it completely from the container. As noted above, since the container is now in the closed and locked position, no further units of product may enter the dispensing trough 32 until the inner tray 28 is placed in the dispensing position.

As set forth in the appended figures, both the inner tray 28 and the outer casing 12 can be manufactured in two pieces that are adapted for connection to form the final design. Any means for connecting multiple pieces of a container could be used without departing from the invention. In the illustrated embodiment, the inner tray 28 comprises a slot 74 at one end of the top portion 36 that engages a tab 72 in the bottom portion 56 of the inner tray. The illustrated embodiment of the top 14 and bottom 16 of the outer casing can be connected through interaction between slots on the top (not shown) and corresponding tabs 78 on the bottom. The slots and the tabs 78 are preferably located on interior walls 80 present in both the top 14 and the bottom 16, which also serve to guide the sliding movement of the inner tray 28 within the outer casing 12.

As part of the final packaging process, once the dispensing containers of the invention are filled with the desired product, the containers can be over-wrapped or over-sealed with a film material, or shrink-wrapped with such a material. The outer packaging material useful in accordance with the present invention can vary. Typically, the selection of the packaging material is dependent upon factors such as aesthetics, transparency, comfort of handling, desired barrier properties (e.g., so as to provide protection from exposure to oxygen or radiation, or so as to provide protection from loss of moisture), or the like. The packaging material preferably has the form of a film, such as a laminated film (e.g., a co-extruded laminated film). Representative materials that can be used to provide components or layers of film materials or laminated films include polyvinyl chloride, ethylene vinyl acetate co-polymer, oriented polypropylene, linear low density polyethylene, polyvinylidene dichloride, polyester terephthalate, ethylene methacrylic acid co-polymer, metallacene linear low density polyethylene, cellulosic materials (e.g., cellophane), and the like. Exemplary packaging materials can be plastic/metal films, plastic/metal films that are paper coated, plastic laminate films, or the like. US 2008/0029116 to Robinson et al. discloses examples of suitable packaging materials.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A dispensing container, comprising:

an outer casing having an open end, a top, a bottom, sidewalls extending between the top and bottom, and an interior compartment;

an inner tray slidably received within the interior compartment of the outer casing and comprising a storage compartment configured to store a plurality of units of product to be dispensed, and a dispensing trough in communication with the storage compartment, the inner tray extending outwardly from the open end of the outer casing and configured for sliding movement between a closed and locked position and an open position, wherein the dispensing trough comprises an aperture sized and configured to allow a single unit of product to exit the dispensing trough at one end thereof and a slot at the opposing end thereof, and wherein the outer casing further comprises a rib extending into the interior compartment and positioned to enter the slot of the dispensing trough as the inner tray slides between the open position and the closed and locked position, the rib sized and configured to engage a unit of product within the dispensing trough as the inner tray slides towards the closed and locked position and urge the unit of product through the aperture of the dispensing trough.

2. The dispensing container of claim 1, further comprising a locking mechanism adapted for releasably locking the inner tray in the closed and locked position within the outer casing, the locking mechanism comprising a depressible button in the top or bottom of the outer casing and a flexible locking plate attached to the inner tray, the depressible button positioned to engage and deflect the flexible locking plate of the inner tray when depressed.

3. The dispensing container of claim 2, wherein the locking plate of the inner tray comprises an aperture and the outer casing comprises a projection adjacent to the depressible button and operatively positioned to engage the aperture of the locking plate when the inner tray is in the closed and locked position.

4. The dispensing container of claim 3, wherein the projection has a beveled surface facing toward the open end of the outer casing.

5. The dispensing container of claim 1, wherein the inner tray further comprises a flexible tab extending into the dispensing trough adjacent to the aperture in the dispensing trough, the tab operatively positioned to engage a unit of product as the unit of product exits the dispensing trough.

6. The dispensing container of claim 1, wherein the inner tray further comprises a stop adapted for engaging the outer casing to prevent removal of the inner tray from the outer casing.

7. The dispensing container of claim 1, wherein the inner tray further comprises a raised surface adapted for grasping by a container user, the raised surface positioned to abut the top of the outer casing when the inner tray is in the closed and locked position.

8. The dispensing container of claim 1, wherein a depression is defined between the inner tray and the bottom of the outer casing when the inner tray is in the closed and locked position, the depression sized and configured to aid grasping of the inner tray.

9. The dispensing container of claim 1, further comprising a recess in the outer casing sized and configured for receiving at least a portion of a unit of product dispensed from the dispensing container.

10. The container of claim 1, wherein the storage compartment is sized to accommodate a plurality of products.

11. The container of claim 1, wherein the product is characterized by a shape selected from the group consisting of pill, tablet, sphere, sheet, coin, cube, bead, ovoid, obloid, bean, stick, and rod.

12. The container of claim 1, wherein the product is selected from the group consisting of pharmaceutical products, smoking products, smokeless tobacco products, snack products, and confectionary products.

13. The container of claim 1, wherein the product is a smokeless tobacco product.

14. The container of claim 1, wherein the product is selected from the group consisting of pharmaceutical products, candies, mints, and gums.

15. The dispensing container of claim 1, wherein the rib extends from the bottom of the outer casing.

16. The dispensing container of claim 1, wherein the dispensing trough defines a depression below the surface of the storage compaitment and is sized and configured to hold only a single unit of product dropped into the dispensing trough from the storage compartment.

17. A dispensing container, comprising:

an outer casing having an open end, a top, a bottom, sidewalls extending between the top and bottom, and an interior compartment;

an inner tray slidably received within the interior compartment of the outer casing and comprising a storage compartment configured to store a plurality of units of product to be dispensed, and a dispensing trough in communication with the storage compartment, the inner tray configured for sliding movement between a closed and locked position and an open position, wherein the dispensing trough comprises an aperture sized and configured to allow a single unit of product to exit the dispensing trough at a first end of the dispensing trough facing the open end of the outer casing, and wherein the dispensing trough further comprises a slot at an opposing end thereof;

a locking mechanism adapted for releasably locking the inner tray in the closed and locked position within the outer casing, the locking mechanism comprising a depressible button in the bottom of the outer casing, a projection extending from the bottom of the outer casing into the interior compartment proximal to the depressible button, and a flexible locking plate attached to the inner tray and facing the bottom of the outer casing, the flexible locking plate including an aperture sized and configured to engage the projection when the inner tray is in the closed and locked position, wherein the depressible button is positioned to deflect the flexible locking plate of the inner tray away from the projection when depressed;

wherein a portion of the inner tray extends outwardly from the open end of the outer casing and comprises a raised surface adapted for grasping by a container user, the raised surface positioned to abut the top of the outer casing when the inner tray is in the closed and locked position, the outwardly-extending portion of the inner tray further comprising a bottom member that abuts the bottom of the outer casing, a depression sized and configured to aid grasping of the inner tray being defined between the bottom member of the outwardly-extending portion of the inner tray and the bottom of the outer casing; and wherein the outer casing further comprises a rib extending into the interior compartment from the bottom of the outer casing and positioned to enter the slot of the dispensing trough as the inner tray slides between the open position and the closed and locked position, the rib sized and configured to engage a unit of product within the dispensing trough as the inner tray slides towards the closed and locked position and urge the unit of product through the aperture of the dispensing trough.

18. The dispensing container of claim 17, wherein the projection has a beveled surface facing toward the open end of the outer casing.

19. The dispensing container of claim 17, wherein the inner tray further comprises a flexible tab extending into the dispensing trough adjacent to the aperture in the dispensing trough, the tab operatively positioned to engage a unit of product as the unit of product exits the dispensing trough.

20. The dispensing container of claim 17, wherein the inner tray further comprises a stop adapted for engaging the outer casing to prevent removal of the inner tray from the outer casing.

21. The container of claim 17, wherein the storage compartment is sized to accommodate a plurality of products.

22. The container of claim 17, wherein the product is characterized by a shape selected from the group consisting of pill, tablet, sphere, sheet, coin, cube, bead, ovoid, obloid, bean, stick, and rod.

23. The container of claim 17, wherein the product is selected from the group consisting of pharmaceutical products, smoking products, smokeless tobacco products, snack products, and confectionary products.

24. The container of claim 17, wherein the product is a smokeless tobacco product.

25. The container of claim 17, wherein the product is selected from the group consisting of pharmaceutical products, candies, mints, and gums.

26. The dispensing container of claim 17, wherein the rib extends from the bottom of the outer casing.

27. The dispensing container of claim 17, wherein the dispensing trough defines a depression below the surface of the storage compartment and is sized and configured to hold only a single unit of product dropped into the dispensing trough from the storage compartment.

28. A method of dispensing a product from a container, comprising:

providing a dispensing container according to claim 1 with the inner tray in the closed and locked position;

sliding the inner tray into the open position;

guiding a unit of product into the dispensing trough while the inner tray is in the open position;

sliding the inner tray into the closed and locked position such that, during said sliding step, the rib of the outer casing engages the slot of the dispensing trough and contacts the unit of product, urging the unit of product through the aperture in the dispensing trough and preventing further units of product from entering the dispensing trough; and removing the unit of product extending from the aperture in the dispensing trough.

29. The method of claim 28, wherein the dispensing container further comprises a locking mechanism adapted for releasably locking the inner tray in the closed and locked position within the outer casing, the locking mechanism comprising a depressible button in the top or bottom of the outer casing and a flexible locking plate attached to the inner tray, the depressible button positioned to engage and deflect the flexible locking plate of the inner tray when depressed, the method further comprising depressing the button to unlock the dispensing container prior to sliding the inner tray into the open position.

* * * * *